US008734624B2

(12) United States Patent
Minami

(10) Patent No.: US 8,734,624 B2
(45) Date of Patent: May 27, 2014

(54) PLATING APPARATUS

(75) Inventor: Yoshio Minami, Tokyo (JP)

(73) Assignee: Ebara Corporation, Tokyo (JP)

( * ) Notice: Subject to any disclaimer, the term of this patent is extended or adjusted under 35 U.S.C. 154(b) by 275 days.

(21) Appl. No.: 13/449,845

(22) Filed: Apr. 18, 2012

(65) Prior Publication Data

US 2012/0305387 A1 Dec. 6, 2012

(30) Foreign Application Priority Data

May 30, 2011 (JP) ..... 2011-120906
Jan. 30, 2012 (JP) ..... 2012-016659

(51) Int. Cl.
*C25D 21/10* (2006.01)
*C25D 21/18* (2006.01)
*C25D 17/02* (2006.01)

(52) U.S. Cl.
CPC ..... *C25D 21/10* (2013.01); *C25D 21/18* (2013.01); *C25D 17/02* (2013.01)
USPC ..... 204/269; 205/101; 204/237

(58) Field of Classification Search
USPC ..... 204/269; 205/101
See application file for complete search history.

(56) References Cited

U.S. PATENT DOCUMENTS 4,935,109 A * 6/1990 Dugan ..... 205/118
5,997,712 A * 12/1999 Ting et al. ..... 205/101
6,113,769 A * 9/2000 Uzoh et al. ..... 205/101
6,136,163 A * 10/2000 Cheung et al. ..... 204/198
6,258,220 B1 * 7/2001 Dordi et al. ..... 204/198
6,406,608 B1 * 6/2002 Uzoh et al. ..... 205/101
6,454,927 B1 * 9/2002 Stevens et al. ..... 205/101
6,458,262 B1 * 10/2002 Reid ..... 205/82
6,527,920 B1 * 3/2003 Mayer et al. ..... 204/237
6,527,934 B1 * 3/2003 Steward ..... 205/101
6,893,548 B2 * 5/2005 Cheung et al. ..... 205/81
6,958,113 B2 * 10/2005 Mizohata et al. ..... 204/224 R
7,087,143 B1 * 8/2006 Schmidt et al. ..... 204/224 R
7,156,972 B2 * 1/2007 Diel et al. ..... 205/98
8,603,305 B2 * 12/2013 Rash et al. ..... 204/237
2002/0027080 A1 * 3/2002 Yoshioka et al. ..... 205/123
2004/0016637 A1 * 1/2004 Yang et al. ..... 204/242
2004/0206623 A1 * 10/2004 D'Ambra et al. ..... 204/275.1
2005/0155865 A1 * 7/2005 Mishima et al. ..... 205/170
2009/0229986 A1 * 9/2009 Omura et al. ..... 205/101

FOREIGN PATENT DOCUMENTS

JP 53-100998 A * 9/1978
JP 59-28597 A 2/1984
JP 5-339794 A 12/1993

* cited by examiner

*Primary Examiner* — Harry D Wilkins, III
(74) *Attorney, Agent, or Firm* — Baker & Hostetler LLP

(57) ABSTRACT

A plating apparatus for plating a surface of a substrate includes a plurality of plating tanks for holding a plating solution therein, a plurality of pumps combined respectively with the plating tanks, for circulating the plating solution through the plating tanks, a plurality of suction pipes connecting respective suction ports of the pumps to the plating tanks, respectively, and a plurality of discharge pipes connecting respective discharge ports of the pumps to respective different ones of the plating tanks from the plating tanks which are connected to the suction ports of the pumps. The plating tanks and the pumps are connected in series with each other.

10 Claims, 11 Drawing Sheets

PLATING APPARATUS

CROSS REFERENCE TO RELATED APPLICATIONS

This document claims priority to Japanese Application Number 2011-120906, filed May 30, 2011 and Japanese Application Number 2012-016659, filed Jan. 30, 2012, the entire contents of which are hereby incorporated by reference.

BACKGROUND OF THE INVENTION

1. Field of the Invention

The present invention relates to a plating apparatus for plating a surface of a workpiece to be plated or substrate such as a semiconductor wafer or the like, and more particularly to a plating apparatus for forming a plated film in fine interconnect trenches, holes or resist openings defined in a surface of a semiconductor wafer, or forming bumps (protrusive electrodes), which are to be electrically connected to package electrodes or the like, on a surface of a semiconductor wafer. The present invention is also concerned with a plating apparatus for filling via holes to form a number of through via plugs in a substrates such as a semiconductor wafer, an interposer, or a spacer for use in three-dimensional packaging for semiconductor chips or the like. More specifically, the present invention relates to a plating apparatus for plating substrates that are held by substrate holders to be immersed in plating tanks.

2. Description of the Related Art

A plating apparatus, which is configured to plate substrates that are held by substrate holders and vertically immersed into the plating solution in a plating tank, is known. Before the plating apparatus starts to operate, the substrate holders are stored in a substrate holder stocker. When the plating apparatus starts to operate, the substrate holders are removed from the substrate holder stocker one by one. Then, the substrate holders hold semiconductor wafers to be plated. The substrate holders, which are holding the semiconductor wafers, are transported by a substrate holder transporter successively to a plating tank where the semiconductor wafers are to be plated and various processing tanks where the semiconductor wafers are to be processed.

The conventional plating apparatus include a plating apparatus having a plurality of plating tanks and plating solution circulating tanks for circulating a plating solution through the plating tanks to plate workpieces therein (see, e.g. Japanese laid-open patent publication No. 5-339794). Specifically, the plating tanks and the plating solution circulating tanks are interconnected, respectively. The plating tanks are supplied with the plating solution from the corresponding plating solution circulating tanks, and the plating solution that has flowed back from each of the plating tanks is returned to the other plating solution circulating tanks than the corresponding plating solution circulating tank, thereby uniformizing the components of the plating solution.

SUMMARY OF THE INVENTION

The plating apparatus disclosed in Japanese laid-open patent publication No. 5-339794 is, however, structurally complex because the plating solution circulating tanks are interconnected by connecting conduits to uniformize the amounts of plating solution discharged from respective pumps that supply the plating solution to the plating tanks.

Furthermore, pipes for returning the plating solution that has flowed back from the plating tanks to the plating solution circulating tanks include many bends and hence have a complex pipe structure that presents an increased pipe resistance to the flow of the plating solution. Therefore, in order to prevent cavitation from developing in the plating solution, it is necessary to increase the size of the pipes.

Moreover, the plating apparatus disclosed in Japanese laid-open patent publication No. 5-339794 uses only one type of plating solution, and is unable to use a plurality of plating solutions having different components.

The present invention has been made in view of the above situation. It is therefore an object of the present invention to provide a plating apparatus which is of a relatively simple structure and is capable of using a plurality of plating solutions having different components.

The present invention provides a plating apparatus for plating a surface of a substrate, comprising a plurality of plating tanks for holding a plating solution therein, a plurality of pumps combined respectively with the plating tanks, for circulating the plating solution through the plating tanks, a plurality of suction pipes connecting respective suction ports of the pumps to the plating tanks, respectively, and a plurality of discharge pipes connecting respective discharge ports of the pumps to respective different ones of the plating tanks from the plating tanks which are connected to the suction ports of the pumps. The plating tanks and the pumps are connected in series with each other.

The plating apparatus may include respective inner tanks each for plating the substrate by immersing it in the plating solution, and respective outer tanks for receiving the plating solution which overflows the inner tanks.

The discharge pipes may be connected to the inner tanks, respectively, and the suction pipes may be connected to the outer tanks, respectively.

The plating apparatus may further comprise a substrate holder for holding the substrate, an anode immersed in each of the plating tanks, and a plating power source for applying a voltage between the surface of the substrate and the anode.

The plating apparatus may further comprise a paddle for agitating the plating solution, the paddle being disposed between the anode and the substrate in each of the plating tanks.

The plating apparatus may further comprise a regulation plate disposed in each of the plating tanks between the anode and the substrate to divide the plating solution into a region near the anode and a region near the substrate, the regulation plate having a central hole defined therein that is essentially identical to an external shape of the substrate.

The discharge pipes may be reconnectable to provide a different interconnected combination of the discharge ports of the pumps and the plating tanks.

Additives may be added to the plating solution in the plating tanks, respectively.

The plating tanks and the pumps may be connected in series with each other in a plurality of plating modules which use respective different types of plating solutions therein.

The plating apparatus may further comprise a balancing pipe interconnecting the plating tanks.

The plating apparatus according to the present invention is capable of using a plurality of plating solutions of different types without developing cavitation therein with a simple structure.

DESCRIPTION OF THE PREFERRED EMBODIMENTS

Preferred embodiments of the present invention will now be described in detail with reference to the drawings.

<Overall Structure of Plating Apparatus>

An overall structure of a plating apparatus according to the present invention will first be described below with reference to FIGS. 1 and 2.

Figure 1:
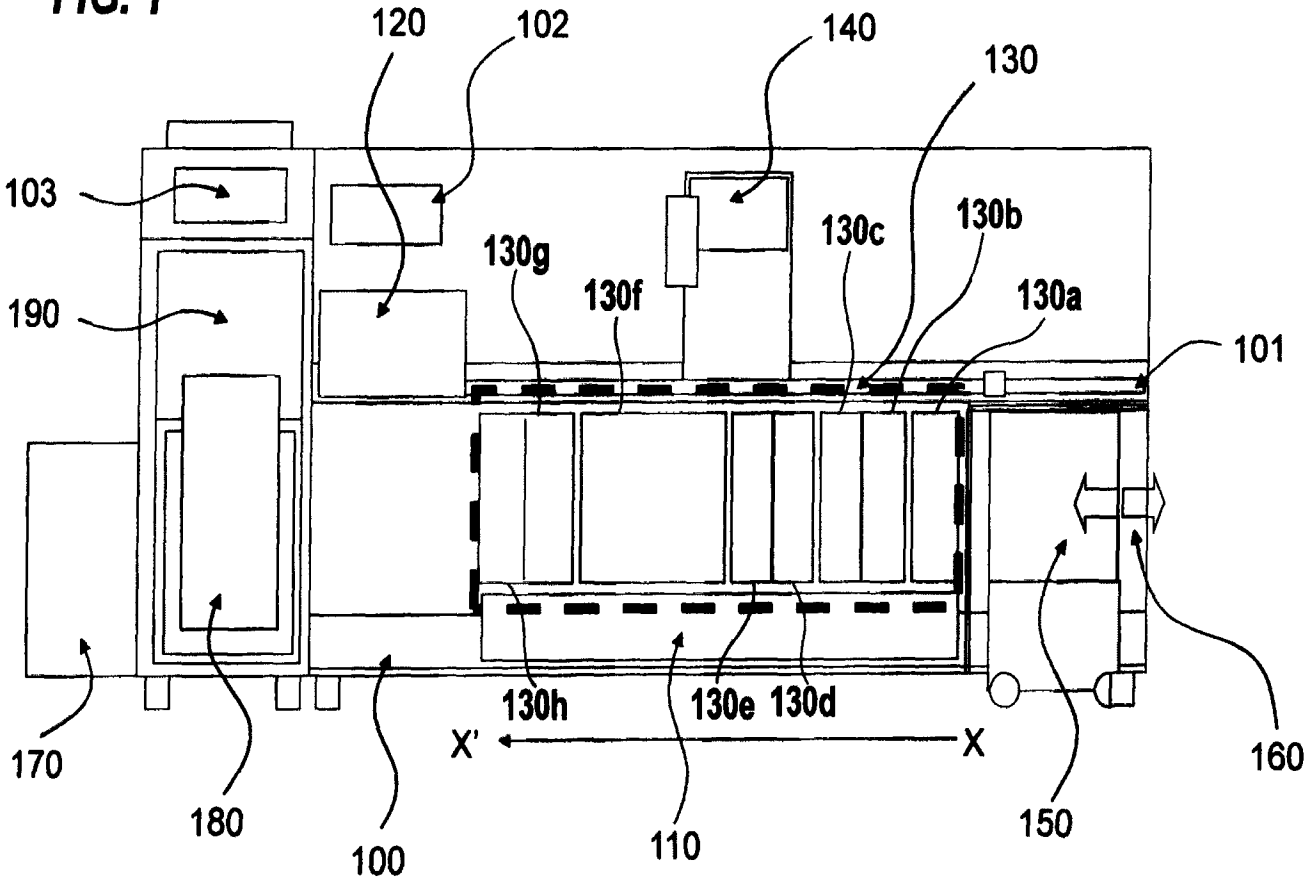
FIG. 1 is a schematic side view of a plating apparatus according to the present invention.
Figure 2:
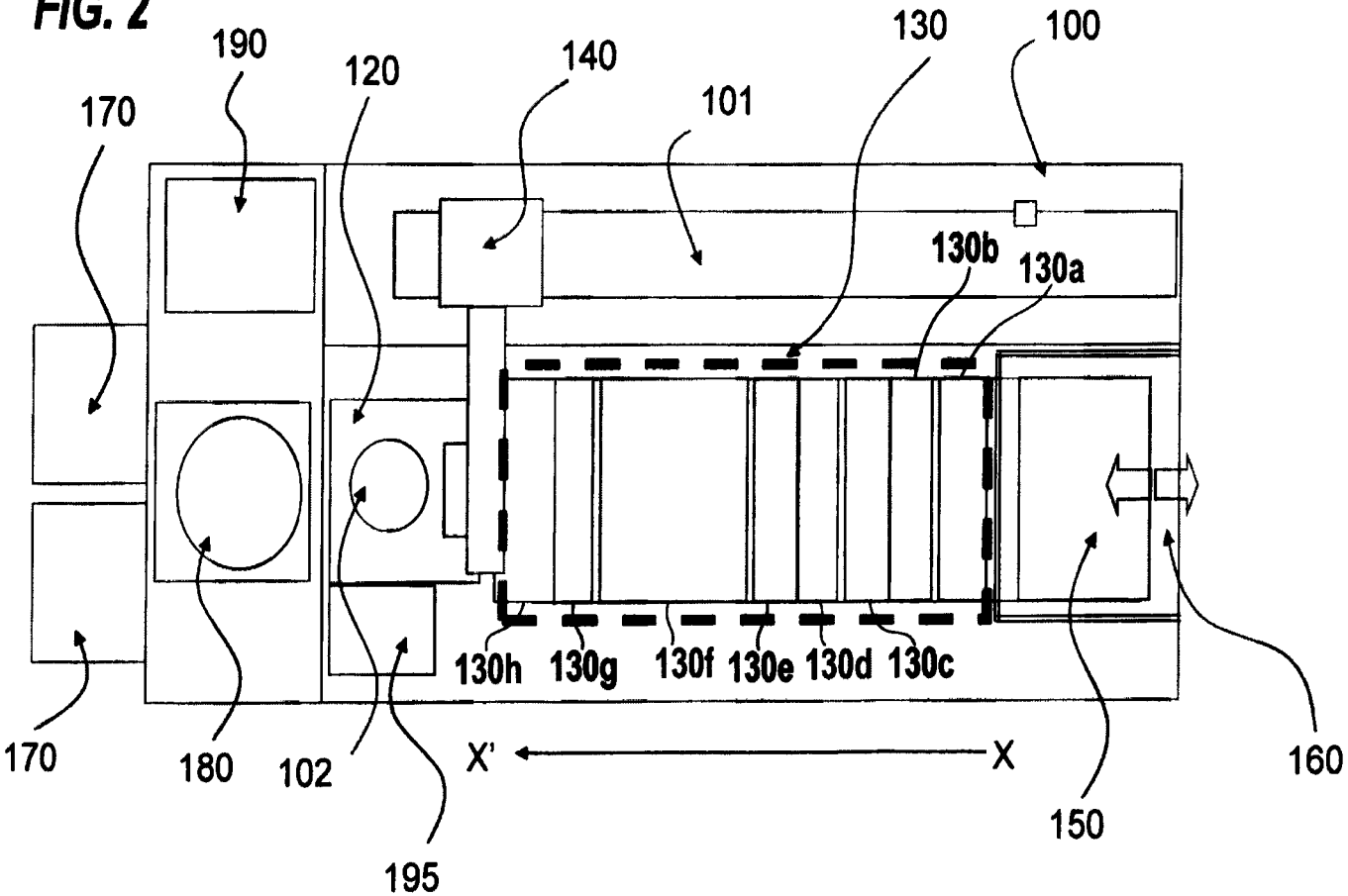
FIG. 2 is a plan view of the plating apparatus shown in FIG. 1.

FIG. 1 is a schematic side view of a plating apparatus according to the present invention, and FIG. 2 is a schematic plan view of the plating apparatus shown in FIG. 1. This plating apparatus serves to plate a surface of a workpiece to be plated or substrate such as a semiconductor wafer or the like, and specifically to form a plated film in fine interconnect trenches, holes or resist openings defined in a surface of a semiconductor wafer, or forming bumps (protrusive electrodes) to be electrically connected to package electrodes or the like on a surface of a semiconductor wafer.

As shown in FIGS. 1 and 2, the plating apparatus according to the present invention has a apparatus frame 100, substrate holders (not shown), loading ports 170 each for placing a substrate cassette such as an FOUP (Front Opening Unified Pod) or the like which houses substrates therein, a substrate transfer robot 180, a spin rinse drier (SRD) 190, a table 120, a plating section 130 having a pump unit 110, a substrate holder transporter 140, a stocker 150, a stocker bay 160, and an aligner 195. The stocker 150, which serves to store substrate holders therein, may be a fixed stocker 150 disposed in the apparatus frame 100, or may alternatively be a wheeled wagon-type stocker that can be moved out of the apparatus frame 100.

The substrate transfer robot 180 removes a substrate from a substrate cassette (not shown), and transfers the substrate to the table 120. The substrate transfer robot 180 also removes a substrate from the table 120 and places the substrate into the substrate cassette. The substrate transfer robot 180 also rotates about its own vertical axis to transfer a substrate between the loading port 170, the table 120, the spin rinse drier 190, and the aligner 195. The spin rinse drier 190 rotates a plated substrate while rinsing the same, and then finally rotates the plated substrate at a higher speed to dry the same.

The aligner 195 angularly positions a substrate into alignment with a certain angular position. Specifically, the aligner 195 detects a notch defined in an edge of a substrate and angularly orients the notch toward an indicated angle by rotating the substrate into alignment with an indicated angular position. The aligner 195 also positions the center of a substrate into alignment with a desired position while rotating the substrate.

The plating apparatus also includes a traveling shaft 101 along which the substrate holder transporter 140 is movable, a substrate holder opening and closing mechanism 102 for opening and closing substrate holders, and a controller 103 for controlling the mechanisms and devices of the plating apparatus. The controller 103 includes a control unit for controlling the substrate holder transporter 140.

When a substrate is plated in a plating solution by the plating apparatus, the substrate holder holds the substrate while exposing the surface thereof to be plated and sealing the edge and reverse side thereof from the plating solution. The substrate holder may have contacts for contacting the peripheral edge of the surface to be plated of the substrate and supplying a plating current from an external power source to the substrate. Before a plating process is initiated, the substrate holders are stored in the stocker 150. During the plating process, the substrate holders are moved between the table 120 and the plating section 130 by the substrate holder transporter 140. After the plating process is terminated, the substrate holders are brought back into the stocker 150.

When the substrate holder is carried to the table 120 by the substrate holder transporter 140, the substrate holder is placed horizontally onto the table 120. The substrate transfer robot 180 removes a substrate from or places a substrate into the substrate holder that lies horizontally on the table 120.

The plating apparatus shown in FIGS. 1 and 2 performs a plating process as follows: The substrate held by the substrate holder is vertically immersed into the plating solution in a plating tank. The plating solution is continuously introduced upwardly into the plating tank from an inlet on its bottom and overflows the plating tank while the substrate is being plated in the plating solution. The plating tank preferably has a plurality of compartments therein. In each of the compartments, a single substrate holder holds one or more substrates that are vertically immersed in the plating solution when they are plated. It is assumed hereinafter that the substrate holder holds a single substrate. When the plating apparatus is an electroplating apparatus, each of the compartments preferably has a plating power source for supplying a plating current to the substrate holder, an anode, a paddle stirrer, and a regulation plate. The anode is supported by an anode holder and has an exposed surface facing the substrate in concentric relation thereto. The substrate that is held by the substrate holder is processed by processing fluids in various processing tanks of the plating section 130. The plating power source applies a voltage between the surface to be plated of the substrate that is held by the substrate holder and the anode held by the anode holder, supplying a plating current to plate the surface to be plated of the substrate.

The paddle stirrer includes paddles which are positioned between the anode and the substrate and are reciprocally movable parallel to the substrate for agitating the plating solution. The regulation plate has a central hole defined therein that is essentially identical to an external shape of the substrate, and is placed between the anode and the substrate to divide the plating solution into a region near the anode and a region near the substrate. The regulation plate thus blocks the plating solution and the plating current except through the central hole, thereby lowering the potential on the peripheral area of the surface to be plated of the substrate held by the substrate holder to uniformize the thickness of a film that is plated on the surface of the substrate.

If the plating apparatus is of the type which uses a two-liquid plating solution, for example, then the processing tanks of the plating section 130 include a pre-water-washing tank 130*a*, a pre-processing tank 130*b*, a rinsing tank 130*c*, a first plating tank 130*d*, a rinsing tank 130*e*, a second plating tank 130*f*, a rinsing tank 130*g*, and a blowing tank 130*h*, for example, as shown in FIGS. 1 and 2. Alternatively, the plating section 130 may have other processing tanks arranged otherwise. The processing tanks should preferably be arranged successively in the order of the plating process along the direction indicated by X→X' for a simpler transport path along which the substrate holder is to be transported by the substrate holder transporter 140.

The substrate holder transporter 140 is movable along the traveling shaft 101 between the table 120, the plating section 130, and the stocker 150 by a transport mechanism (not shown), such as a linear motor. The substrate holder transporter 140 holds and transports the substrate holder in a vertical attitude.

Structural details of the plating tanks of the plating section 130 according to the present invention will be described later with reference to FIGS. 3 through 11.

A sequence of plating operation of the plating apparatus shown FIGS. 1 and 2 will be described below.

(a) The substrate holder transporter 140 moves to a position over the stocker 150, and removes and holes a substrate holder stored in the stocker 150.

(b) Then, the substrate holder transporter 140, which is holding the substrate holder, moves along the traveling shaft 101 to the table 120, and places the substrate holder horizontally on the table 120.

(c) A substrate to be plated is set in the substrate holder on the table 120.

(d) The substrate holder transporter 140, holding the substrate holder vertically, moves along the traveling shaft 101 to the pre-water-washing tank 130*a* of the plating section 130. The substrate held by the substrate holder is processed in the processing tanks 130*a* through 130*h* of the plating section 130 according to a plating process. The plating process is performed successively in the processing tanks 130*a* through 130*h* along the direction indicated by X→X'.

(e) After the substrate is processed in the processing tanks 130*a* through 130*h* of the plating section 130, the substrate holder transporter 140 moves to the table 120 while holding the substrate holder vertically, and then places the substrate holder horizontally on the table 120.

(f) The plated substrate is removed from the substrate holder.

(g) If the plating process is to be performed continuously, then a substrate to be processed is set in the substrate holder, and steps (d) through (f) are repeated.

(h) When the plating process is completed, the substrate holder transporter 140 vertically holding the substrate holder, from which the substrate has been removed, moves to the stocker 150, and places the substrate holder vertically into the stocker 150.

The plating apparatus performs the sequence of plating operation as described above. Structural details of the plating tanks of the plating section 130 of the present invention will be described later with reference to FIGS. 3 through 11.

<Structure of Plating Tank>

Figure 3:
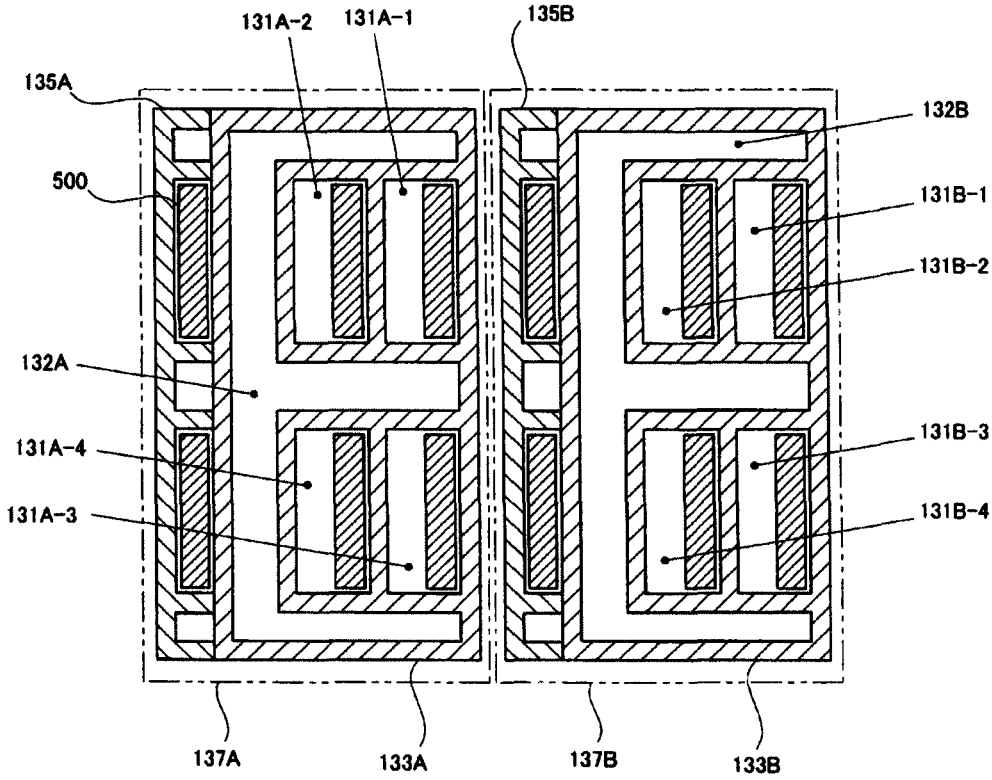
FIG. 3 is a cross-sectional view of plating tanks of a plating apparatus according to the present invention.

FIG. 3 is a cross-sectional view of plating tanks 133A, 133B of the plating apparatus of the present invention. As shown in FIG. 3, the plating tanks 133A, 133B include inner tanks 131A-1 through 131A-4 and 131B-1 through 131B-4, respectively, and outer tanks 132A, 132B, respectively, and provide plating units 137A, 137B, respectively. As shown in FIG. 3, the outer tanks 132A, 132B are disposed in surrounding relation to the inner tanks 131A-1 through 131A-4 and 131B-1 through 131B-4, respectively. The inner tanks 131A-1 through 131A-4 and 131B-1 through 131B-4 are plating tanks for plating the surfaces of substrates held by substrate holders 500. The outer tanks 132A, 132B are overflow tanks for receiving a plating solution that has overflowed the inner tanks 131A-1 through 131A-4 and 131B-1 through 131B-4, respectively. In FIG. 3, each of the two plating tanks 133A, 133B includes four inner tanks 131A-1 through 131A-4 or 131B-1 through 131B-4 and one outer tank 132A or 132B. However, each of the two plating tanks 133A, 133B may include at least one inner tank 131A or 131B and one outer tank 132A or 132B. The inner tanks 131A-1 through 131A-4 and 131B-1 through 131B-4 will also be collectively referred to as inner tanks 131A, 131B, respectively.

As shown in FIG. 3, the plating units 137A, 137B may include respective rinsing tanks 135A, 135B in addition to the plating tanks 133A, 133B. Each of the rinsing tanks 135A, 135B may have a plurality of rinsing compartments. The rinsing tanks 135A, 135B may be disposed adjacent to the plating tanks 133A, 133B, respectively.

The inner tanks 131A, 131B have respective jet ports (not shown) defined in the bottoms thereof for introducing the plating solution into the inner tanks 131A, 131B. The outer tanks 132A, 132B have respective discharge ports (not shown) for sending the plating solution that has overflowed the inner tanks 131A, 131B to circulating units 111A through 111D (see FIG. 4). When the inner tanks 131A-1 through 131A-4 and 131B-1 through 131B-4 are filled with the plating solution, the substrates held by the substrate holders 500 are immersed vertically into the plating solution. The substrates are plated in the plating solution which is being introduced from the jet ports into the inner tanks 131A-1 through 131A-4 and 131B-1 through 131B-4 and overflowing the inner tanks 131A-1 through 131A-4 and 131B-1 through 131B-4. Since the plating solution flows upwardly from the bottoms of the inner tanks 131A, 131B, even if air bubbles are produced in the plating solution, they can easily be removed from the plating solution so as not to form defects in plated films to be formed on the substrates.

The plating tanks 133A, 133B, which perform a plating process as described above, may use different types of plating solutions, respectively. Alternatively, the plating tanks 133A, 133B may be interconnected by pipes and may use one type of plating solution.

First Embodiment

Plating tanks 133A through 133D provided in a plating apparatus according to a first embodiment of the present invention will be described below with reference to FIG. 4.

Figure 4:
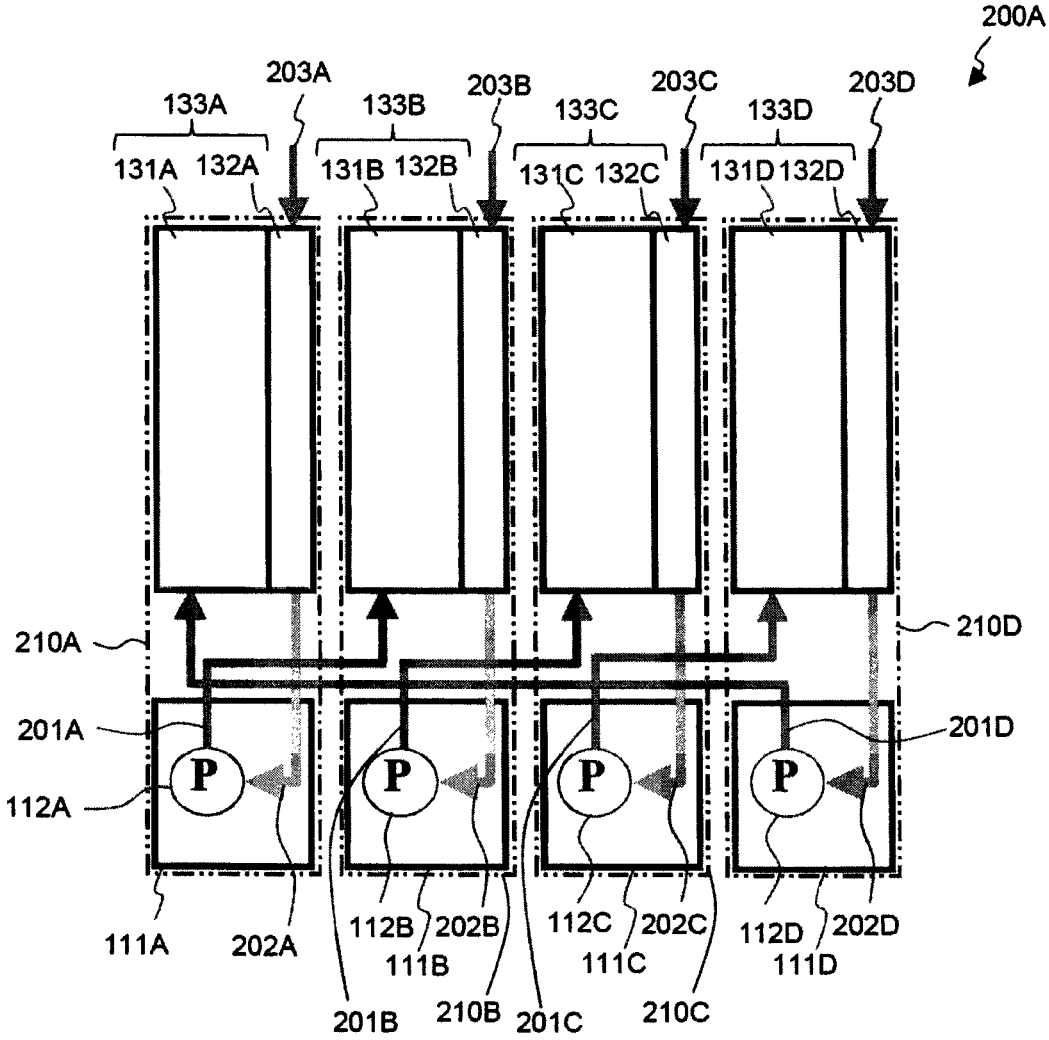
FIG. 4 is a schematic view of plating tanks of a plating apparatus according to a first embodiment of the present invention.

FIG. 4 is a schematic view of plating tanks 133A through 133D of a plating apparatus according to a first embodiment of the present invention. As shown in FIG. 4, the plating tanks 133A through 133D include inner tanks 131A through 131D, respectively, and outer tanks 132A through 132D, respectively. Each of the inner tanks 131A through 131D may be a single inner tank or a plurality of inner tanks, as shown in FIG. 3. The plating tanks 133A through 133D are interconnected by pumps 112A through 112D of a plurality of circulating units 111A through 111D and a plurality of pipes 201A through 201D, 202A through 202D. The plating tanks 133A through 133D are combined respectively with the pumps 112A through 112D in one-to-one correspondence. Therefore, the circulating units 111A through 111D, which include the respective pumps 112A through 112D, are also combined respectively with the plating tanks 133A through 133D in one-to-one correspondence.

As shown in FIG. 4, the plating tanks 133A through 133D and the corresponding circulating units 111A through 111D jointly make up plating units 210A through 210D, respectively. The plating units 210A through 210D may include rinsing tanks, as with the plating units 137A, 137B shown in FIG. 3.

The circulating units 111A through 111D may include, in addition to the pumps 112A through 112D, filters, pressure switches, and flow rate regulating valves, and, if necessary, heat exchangers, sampling lines, etc.

The outer tanks 132A through 132D have respective discharge ports (not shown) which are connected by respective suction pipes 202A through 202D to respective suction ports of the pumps 112A through 112D which are combined respectively with the plating tanks 133A through 133D including the outer tanks 132A through 132D.

The inner tanks 131A through 131D have, on the other hand, respective jet ports (not shown) which are connected by discharge pipes 201A through 201D to respective discharge ports of other ones of the pumps 112A through 112D which are combined respectively with the plating tanks 133A through 133D including the inner tanks 131A through 131D. In other words, the discharge pipes 201A through 201D are connected to other ones of the plating tanks 133A through 133D which are connected to the suction ports of the pumps 112A through 112D.

As shown in FIG. 4, the plating tanks 133A through 133D and the pumps 112A through 112D are connected in series with each other by the discharge pipes 201A through 201D and the suction pipes 202A through 202D. Therefore, a plating solution can circulate through the plating tanks 133A through 133D. The plating tanks 133A through 133D and the pumps 112A through 112D are connected in series with each other jointly make up a plating module 200A in which the common plating solution is mixed and circulated.

As shown in FIG. 4, it is assumed that the plating module 200A includes the four plating tanks 133A through 133D and the four pumps 112A through 112D. The suction port of the pump 112A is connected to the outer tank 132A of the plating tank 133A, and the discharge port of the pump 112B is connected to the inner tank 131B of the plating tank 133B. The suction port of the pump 112B is connected to the outer tank 132B of the plating tank 133B, and the discharge port of the pump 112B is connected to the inner tank 131C of the plating tank 133C. The suction port of the pump 112C is connected to the outer tank 132C of the plating tank 133C, and the discharge port of the pump 112C is connected to the inner tank 131D of the plating tank 133D. The suction port of the pump 112D is connected to the outer tank 132D of the plating tank 133D, and the discharge port of the pump 112D is connected to the inner tank 131A of the plating tank 133A.

In the plating module 200A having a structure as described above, the suction pipes 202A through 202D are connected respectively to the plating tanks 133A through 133D of the plating units 210A through 210D that include the respective pumps 112A through 112D. The suction pipes 202A through 202D are of a diameter greater than the discharge pipes 201A through 201D in order to reduce the rate at which the plating solution flows through the suction pipes 202A through 202D. The suction pipes 202A through 202D are preferably of a simple pipe structure. On the other hand, the discharge pipes 201A through 201D are connected respectively to the plating tanks 133B, 133C, 133D, 133A of the plating units 210B, 210C, 210D, 210A, i.e., different ones of the plating units 210A through 210D that include the respective pumps 112A through 112D. The discharge pipes 201A through 201D are of a diameter smaller than the suction pipes 202A through 202D, and may be in the form of tubes of fluorine resin (PFA) if the plating solution flows therethrough at a rate of about 10 L/min. Therefore, the discharge pipes 201A through 201D can thus be replaced or changed with relative ease.

The discharge ports of the outer tanks 132A through 132D are connected to the suction ports of the pumps 112A through 112D by a simple structure, i.e., the respective suction pipes 202A through 202D. Such a simple piping is effective to reduce the pipe resistance to the plating solution at the suction ports of the pumps 112A through 112D. Therefore, there is no need to increase the size of the suction pipes 202A through 202D in order to prevent cavitation from developing at the suction ports of the pumps 112A through 112D.

The discharge ports of the pumps 112A through 112D are connected by the respective discharge pipes 201A through 201D respectively to the jet ports of the inner tanks 131B, 131C, 131D, 131A of the plating tanks 133B, 133C, 133D, 133A of the plating units 210B, 210C, 210D, 210A, i.e., different ones of the plating units 210A through 210D that include the respective pumps 112A through 112D. The discharge pipes 201A through 201D that are connected to the discharge ports of the pumps 112A through 112D are thus of a slightly complex structure, possibly tending to provide an increased pipe resistance. However, the pumps 112A through 112D may be constructed to discharge the plating solution under an increased pressure against the increased pipe resistance. Since the pumps 112A through 112D discharge the plating solution under pressure from the discharge ports thereof, there is no danger of cavitation developing in the discharged plating solution. In other words, the discharge pipes 201A through 201D do not need have an increased diameter to prevent cavitation, unlike the suction pipes 202A through 202D. Therefore, if the type of the plating solution used is changed, i.e., if the pattern of operation of the plating apparatus is changed, then the discharge pipes 201A through 201D can easily be replaced with discharge pipes having a different tank connecting layout.

The plating apparatus according to the first embodiment of the present invention is thus effective to prevent cavitation with a simple structure and to allow the common plating solution to be mixed and circulated through the plating tanks 133A through 133D because the discharge pipes 201A through 201D, which are connected respectively to the discharge ports of the pumps 112A through 112D, are connected respectively to other ones of the plating tanks 133A through 133D. The tank connecting layout shown in FIG. 4 is suitable for using one type of plating solution in four plating tanks.

As shown in FIG. 4, additives 203A through 203D for adjusting the components of the plating solution may be supplied individually to the plating tanks 133A through 133D. Specifically, the plating tanks 133A through 133D have respective additive supply ports (not shown) connected respectively to additive supply units (not shown). In FIG. 4, the additives 203A through 203D are introduced into the outer tanks 132A through 132D. Therefore, the plating solution mixed with the additives 203A through 203D is supplied from the outer tanks 132A through 132D to the inner tanks 131A through 131D through the pumps 112A through 112D.

Since the plating tanks 133A through 133D of the plating apparatus according to the first embodiment of the present invention are thus connected in series with each other, it is possible to analyze the components of the plating solution in one process only.

Specifically, the components of the plating solution can be analyzed by opening a valve on a branch from one of the discharge pipes 201A through 201D to extract the plating solution therefrom. Alternatively, a drain port may be provided in one of the outer tanks 132A through 132D, and a drain cock connected to the drain port may be opened to extract the plating solution therefrom. Since it is not necessary to titrate the plating solution for each of the plating tanks 133A through 133D, the plating apparatus according to the first embodiment of the present invention may analyze the plating solution in one titrating process for the plating tanks 133A through 133D that are interconnected each other.

As described above, with the plating apparatus according to the first embodiment of the present invention, the plating tanks 133A through 133D and the pumps 112A through 112D of the plating units 210A through 210D are interconnected by the respective suction pipes 202A through 202D which are of a simple pipe structure, and the plating tanks 133A through 133D and the pumps 112A through 112D of different ones of the plating units 210A through 210D are interconnected by the respective discharge pipes 201A through 201D, with the plating tanks 133A through 133D being connected in series with each other to make up the plating module 200A. Consequently, the plating apparatus is of a simple structure that is capable of mixing and circulating the plating solution without developing cavitation therein, and allows the polishing solution to be titrated in a reduced number of titrating processes.

Second Embodiment

A plating apparatus according to a second embodiment of the present invention, which can use a plurality of different types of plating solutions, will be described below with reference to FIG. 5.

Figure 5:
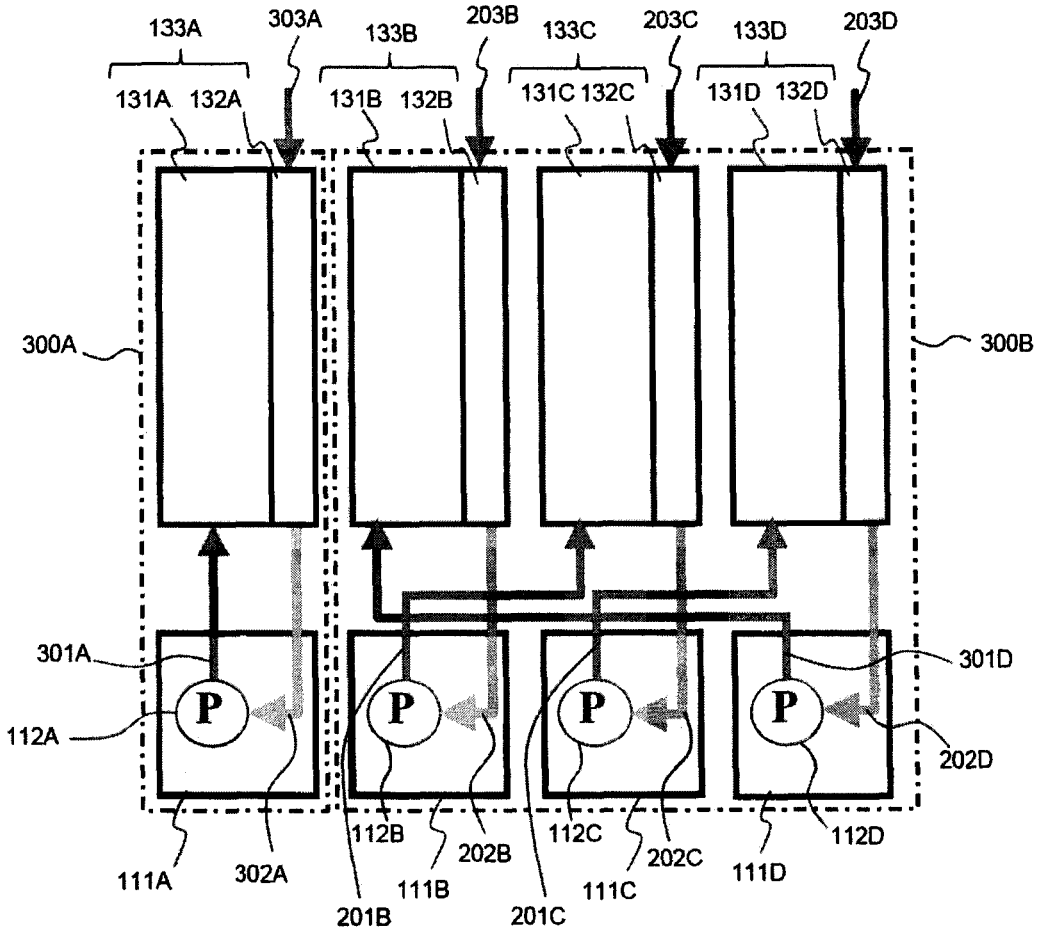
FIG. 5 is a schematic view of plating tanks of a plating apparatus according to a second embodiment of the present invention.

FIG. 5 is a schematic view of plating tanks 133A through 133D of a plating apparatus according to a second embodiment of the present invention. As shown in FIG. 5, the plating tanks 133A through 133D of the plating apparatus according to the second embodiment of the present invention include inner tanks 131A through 131D, respectively, and outer tanks 132A through 132D, respectively, as with the plating tanks 133A through 133D according to the first embodiment. The plating tanks 133A through 133D are combined with respective circulating units 111A through 111D which include respective pumps 112A through 112D in one-to-one correspondence. The plating tanks 133A through 133D and the corresponding circulating units 111A through 111D make up plating units 210A through 210D, not shown, as with the first embodiment shown in FIG. 4. Those parts of the plating tanks 133A through 133D according to the second embodiment, which are identical to those of the plating tanks 133A through 133D according to the first embodiment, are denoted by identical reference characters, and will not be described in detail below.

As shown in FIG. 5, the plating tank 133A is connected to the pump 112A of the circulating unit 111A by a discharge pipe 301A and a suction pipe 302A. The plating tanks 133B through 133D are connected to pumps 112B through 112D of circulating units 111B through 111D by discharge pipes 201B, 201C, 301D and suction pipes 202B through 202D, respectively. The plating tank 133A and the pump 112A, which are interconnected jointly, make up a first plating module 300A. The plating tanks 133B through 133D and the pumps 112B through 112D, which are interconnected jointly, make up a second plating module 300B. The first plating module 300A and the second plating module 300B are not connected to each other by pipes, and hence can circulate respective plating solutions of different components for performing different plating processes.

In the first plating module 300A, the plating tank 133A and the pump 112A of the plating unit 210A (see FIG. 4) are connected in series with each other. The discharge port of the outer tank 132A of the plating tank 133A is connected to the suction port of the pump 112A by the suction pipe 302A, and the jet port of the inner tank 131A of the plating tank 133A is connected to the discharge port of the pump 112A by the discharge pipe 301A.

In the second plating module 300B, on the other hand, the plating tanks 133B through 133D and the pumps 112B through 112D are connected in series with each other, as with the plating tanks 133A through 133D and the pumps 112A through 112D according to the first embodiment of the present invention. In the second plating module 300B, the suction pipes 202B through 202D interconnect the plating tanks 133B through 133D and the pumps 112B through 112D, respectively, of the same plating units 210B through 210D (see FIG. 4), and the discharge pipes 201B, 201C, 301D interconnect the plating tanks 133C, 133D, 133B and the pumps 112B through 112D, respectively, of the different plating units 210B through 210D (see FIG. 4).

As with the plating module 200A according to the first embodiment, the second plating module 300B is effective to allow the plating solution to be mixed and circulated through the plating tanks 133B through 133D while preventing cavitation with a simple structure. In addition, since the polishing solution can be titrated for each of the plating modules 300A, 300B, not for each of the plating tanks 133A through 133D, the number of titrating processes required can be reduced.

As the first plating module 300A and the second plating module 300B are structurally independent of each other, the plating tank 133A of the first plating module 300A can be supplied with an additive 303A which is of a different type from additives 203B through 203D supplied to the plating tanks 133B through 133D of the second plating module 300B. Consequently, the first plating module 300A and the second plating module 300B of one plating apparatus can perform plating processes using different types of plating solutions.

The plating apparatus according to the first embodiment shown in FIG. 4 can be modified into the plating apparatus according to the second embodiment shown in FIG. 5 by reconnecting some of the suction and discharge pipes connected to the plating tanks 133A through 133D. Since the discharge pipes 301A, 201B, 201C, 301D can be of a smaller diameter than the suction pipes 302A, 202B through 202D, as with the plating apparatus according to the first embodiment, the discharge pipes 301A, 201B, 201C, 301D can easily be reconnected. For example, the discharge pipe 201A connected between the discharge port of the pump 112A and the inner tank 131B shown in FIG. 4 may be reconnected as the discharge pipe 301A connected between the discharge port of the pump 112A and the inner tank 131A shown in FIG. 5, and the discharge pipe 201D connected between the discharge port of the pump 112D and the inner tank 131A shown in FIG. 4 may be reconnected as the discharge pipe 301D connected between the discharge port of the pump 112D and the inner tank 131B shown in FIG. 5, thereby constructing the plating modules 300A, 300B shown in FIG. 5.

The suction pipes 302A, 202B through 202D interconnect the suction ports of the pumps 112A through 112D and the discharge ports of the outer tanks 132A through 132D of the same plating units 210B through 210D (see FIG. 4), as with the plating apparatus according to the first embodiment. Such a simple piping is effective to reduce the pipe resistance to the plating solution at the suction ports of the pumps 112A through 112D. Therefore, it is possible to prevent cavitation from developing at the suction ports of the pumps 112A through 112D without the need for an increase in the size of the suction pipes 302A, 202B through 202D.

The plating tank 133A of the first plating module 300A shown in FIG. 5 is supplied with a plating solution which is of a different type from the plating solution used in the plating tank 133A of the plating module 200A shown in FIG. 4. Therefore, if the plating apparatus shown in FIG. 4, which has already been used, is modified into the plating apparatus shown in FIG. 5 by reconnecting some of the suction and discharge pipes, then it is necessary to clean the interior of the plating tank 133A and also to clean the interior of the suction pipe 202A shown in FIG. 4 or reconnect the suction pipe 202A as the suction pipe 302A shown in FIG. 5. With the plating tank 133A cleaned and the suction pipe 202A cleaned or reconnected as the suction pipe 302A, the resultant plating apparatus is capable of using different types of platting solutions.

As described above, the plating apparatus according to the second embodiment of the present invention includes a plurality of plating modules 300A, 300B depending on a maximum possible number of types of plating solutions to be used, provided by reconnecting some of the suction and discharge pipes connected to the plating tanks 133A through 133D. The plating apparatus thus constructed is capable of performing different plating processes in the respective plating modules 300A, 300B. The plating apparatus according to the second embodiment of the present invention is thus capable of mixing and circulating the plating solution through the plating tanks 133B through 133D while preventing cavitation with a simple structure, as with the plating apparatus according to the first embodiment of the present invention. In addition, since the polishing solution can be titrated for each of the plating modules 300A, 300B, not for each of the plating tanks 133A through 133D, the number of titrating processes required can be reduced.

Third Embodiment

A plating apparatus according to a third embodiment of the present invention, which can also use a plurality of different types of plating solutions, as with the plating apparatus according to the second embodiment of the present invention, will be described below with reference to FIG. 6.

Figure 6:
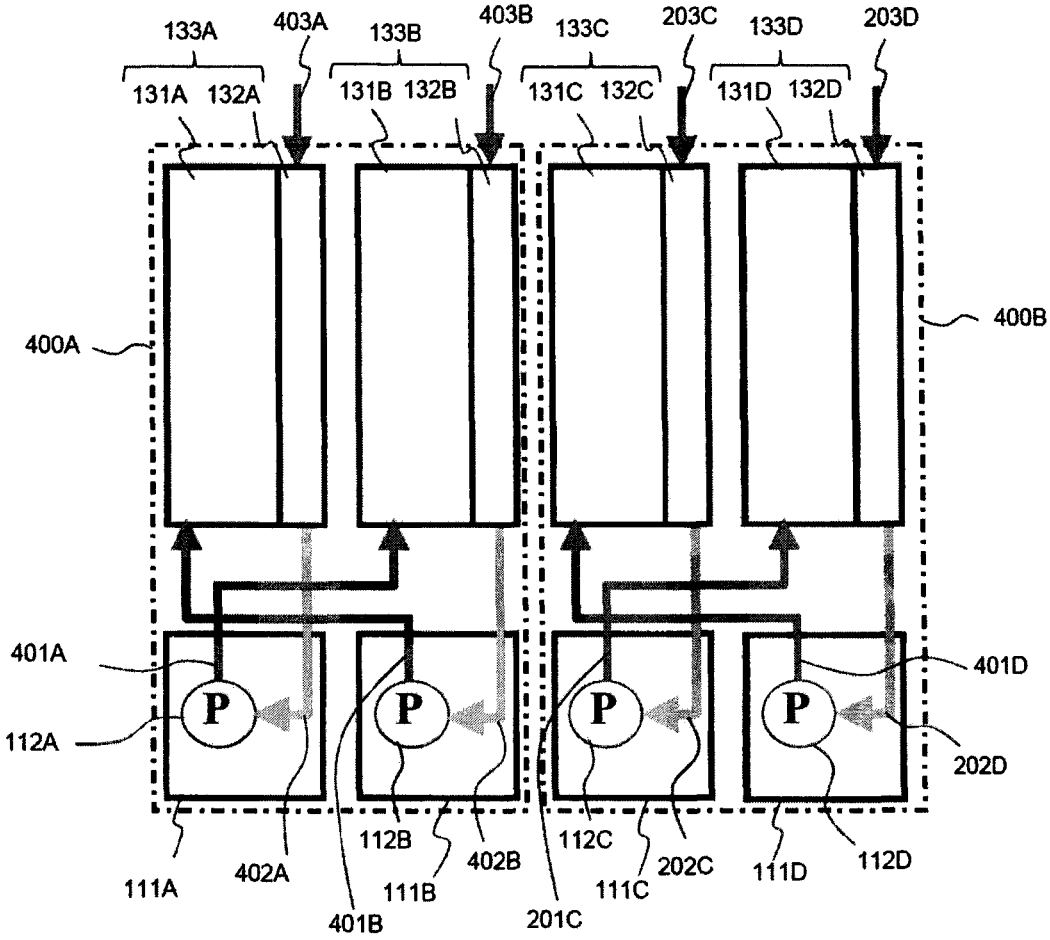
FIG. 6 is a schematic view of plating tanks of a plating apparatus according to a third embodiment of the present invention.

FIG. 6 is a schematic view of plating tanks 133A through 133D of a plating apparatus according to a third embodiment of the present invention. As shown in FIG. 6, the plating tanks 133A through 133D of the plating apparatus according to the third embodiment of the present invention include inner tanks 131A through 131D, respectively, and outer tanks 132A through 132D, respectively, as with the plating tanks 133A through 133D according to the first and second embodiments. The plating tanks 133A through 133D are combined with respective circulating units 111A through 111D which include respective pumps 112A through 112D in one-to-one correspondence. The plating tanks 133A through 133D and the corresponding circulating units 111A through 111D make up plating units 210A through 210D, not shown, as with the first embodiment shown in FIG. 4. Those parts of the plating tanks 133A through 133D according to the third embodiment, which are identical to those of the plating tanks 133A through 133D according to the first and second embodiments, are denoted by identical reference characters, and will not be described in detail below.

As shown in FIG. 6, the plating tanks 133A, 133B are connected to the pumps 112A, 112B of the circulating tanks 111A, 111B by discharge pipes 401A, 401B and suction pipes 402A, 402B, respectively. The plating tanks 133C, 133D are connected to the pumps 112C, 112D of the circulating tanks 111C, 111D by discharge pipes 201C, 401D and suction pipes 202C, 202D, respectively. The plating tanks 133A, 133B and the pumps 112A, 112B, which are interconnected jointly, make up a first plating module 400A, and the plating tanks 133C, 133D and the pumps 112C, 112D, which are interconnected jointly, make up a second plating module 400B. The first plating module 400A and the second plating module 400B are not connected to each other by pipes, and hence can circulate respective plating solutions of different components for performing different plating processes.

In the first plating module 400A, the suction pipes 402A, 402B interconnect the plating tanks 133A, 133B and the pumps 112A, 112B of the same plating units 210A, 210B (see FIG. 4), and the discharge pipes 401A, 401B interconnect the plating tanks 133A, 133B and the pumps 112A, 112B of the different plating units 210A, 210B (see FIG. 4). In the second plating module 400B, the suction pipes 202C, 202D interconnect the plating tanks 133C, 133D and the pumps 112C, 112D of the same plating units 210C, 210D (see FIG. 4), and the discharge pipes 201C, 401D interconnect the plating tanks 133C, 133D and the pumps 112C, 112D of the different plating units 210C, 210D (see FIG. 4). Since the plating tanks 133A, 133B and the pumps 112A, 112B are connected in series with each other in the first plating module 400A, and the plating tanks 133C, 133D and the pumps 112C, 112D are connected in series with each other in the second plating module 400B, each of the plating modules 400A, 400B is similar to the plating module 200A according to the first embodiment and the second plating module 300B according to the second embodiment.

As with the first embodiment, the first plating module 400A and the second plating module 400B according to the third embodiment are thus capable of mixing and circulating the plating solution through the plating tanks 133A, 133B and the plating tanks 133C, 133D while preventing cavitation with a simple structure. In addition, since the polishing solution can be titrated for each of the plating modules 400A, 400B, not for each of the plating tanks 133A through 133D, the number of titrating processes required can be reduced.

As the first plating module 400A and the second plating module 400B are structurally independent of each other, the plating tanks 133A, 133B of the first plating module 400A can be supplied with additives 403A, 403B which are of a different type from additives 203C, 203D supplied to the plating tanks 133C, 133D of the second plating module 400B. Consequently, the first plating module 400A and the second plating module 400B of one plating apparatus can perform plating processes using different types of plating solutions.

The plating apparatus according to the first embodiment shown in FIG. 4 can be modified into the plating apparatus according to the third embodiment shown in FIG. 6 by reconnecting some of the suction and discharge pipes connected to the plating tanks 133A through 133D. Since the discharge pipes 401A, 401B, 201C, 401D can be of a smaller diameter than the suction pipes 402A, 402B, 202C, 202D, as with the plating apparatus according to the first embodiment, the discharge pipes 401A, 401B, 201C, 401D can easily be reconnected. For example, the discharge pipe 201B connected between the discharge port of the pump 112B and the inner tank 131C shown in FIG. 4 may be reconnected as the discharge pipe 401B connected between the discharge port of the pump 112B and the inner tank 131A shown in FIG. 6, and the discharge pipe 201D connected between the discharge port of the pump 112D and the inner tank 131A shown in FIG. 4 may be reconnected as the discharge pipe 401D connected between the discharge port of the pump 112D and the inner tank 131C shown in FIG. 6, thereby constructing the plating modules 400A, 400B shown in FIG. 6.

The suction pipes 402A, 402B, 202C, 202D interconnect the suction ports of the pumps 112A through 112D and the discharge ports of the outer tanks 132A through 132D with a simple structure, as with the plating apparatus according to the first embodiment. Such a simple piping is effective to reduce the pipe resistance to the plating solution at the suction ports of the pumps 112A through 112D. Therefore, it is possible to prevent cavitation from developing at the suction ports of the pumps 112A through 112D without the need for an increase in the size of the suction pipes 402A, 402B, 202C, 202D.

The plating tanks 133A, 133B of the first plating module 400A shown in FIG. 6 are supplied with a plating solution which is of a different type from the plating solution used in the plating tanks 133A, 133B shown in FIG. 4. Therefore, if the plating apparatus shown in FIG. 4, which has already been used, is modified into the plating apparatus shown in FIG. 6 by reconnecting some of the suction and discharge pipes, then it is necessary to clean the interior of the plating tanks 133A, 133B and also to clean the interior of the suction pipes 202A, 202B shown in FIG. 4 or reconnect the suction pipes 202A, 202B as the suction pipes 402A, 402B shown in FIG. 6. With the plating tanks 133A, 133B cleaned and the suction pipes 202A, 202B cleaned or reconnected as the suction pipes 402A, 402B, the resultant plating apparatus is capable of using different types of platting solutions.

As described above, the plating apparatus according to the third embodiment of the present invention includes a plurality of plating modules 400A, 400B depending on a maximum possible number of types of plating solutions to be used, provided by reconnecting some of the suction and discharge pipes connected to the plating tanks 133A through 133D. The plating apparatus thus constructed is capable of performing different plating processes in the respective plating modules 400A, 400B. The plating apparatus according to the third embodiment of the present invention is thus capable of mixing and circulating the plating solution through the plating tanks 133A, 133B and the plating tanks 133C, 133D while preventing cavitation with a simple structure, as with the plating apparatus according to the first and second embodiments. In addition, since the polishing solution can be titrated for each of the plating modules 400A, 400B, not for each of the plating tanks 133A through 133D, the number of titrating processes required can be reduced.

<Comparison of Changes in the Mixture Ratios of Plating Solutions>

Comparison of changes in the mixture ratios of plating solutions used in the plating apparatus according to the first embodiment of the present invention and a plating apparatus according to a comparative example with respect to the plating apparatus according to the first embodiment of the present invention will be described below with reference to FIGS. 7 and 9 which illustrate results of a simulation.

Figure 7:
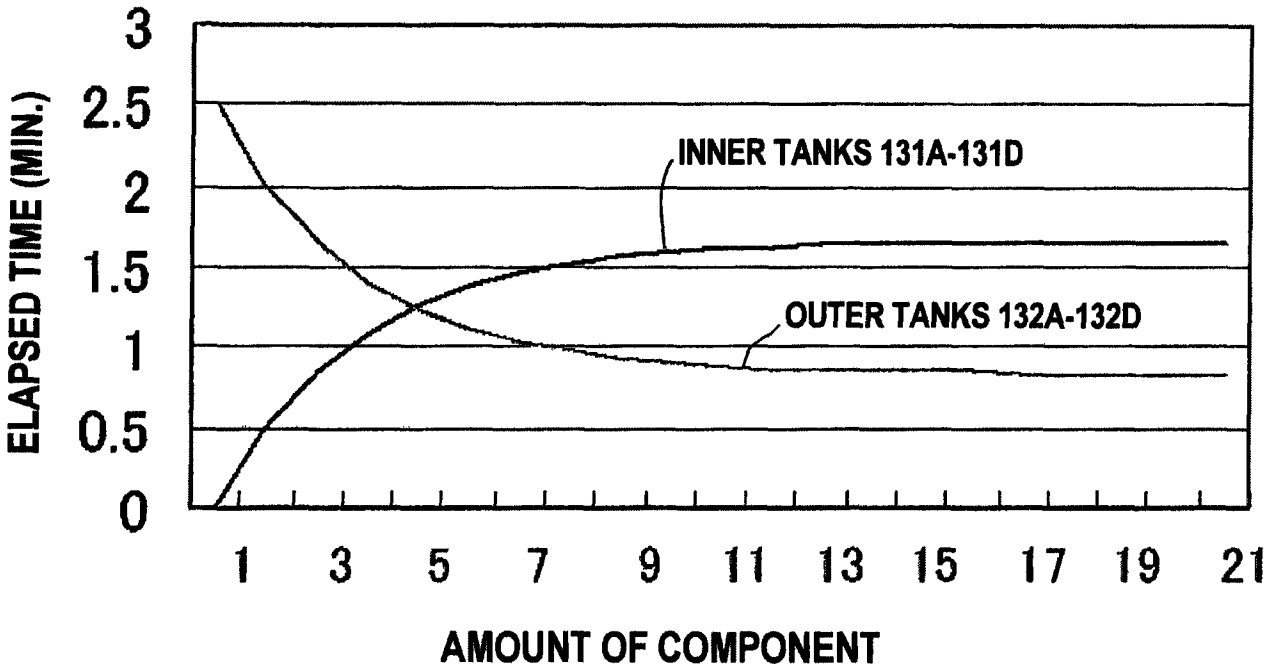
FIG. 7 is a diagram showing how the mixture ratios of a plating solution in the plating tanks shown in FIG. 4 change with time.
Figure 8:
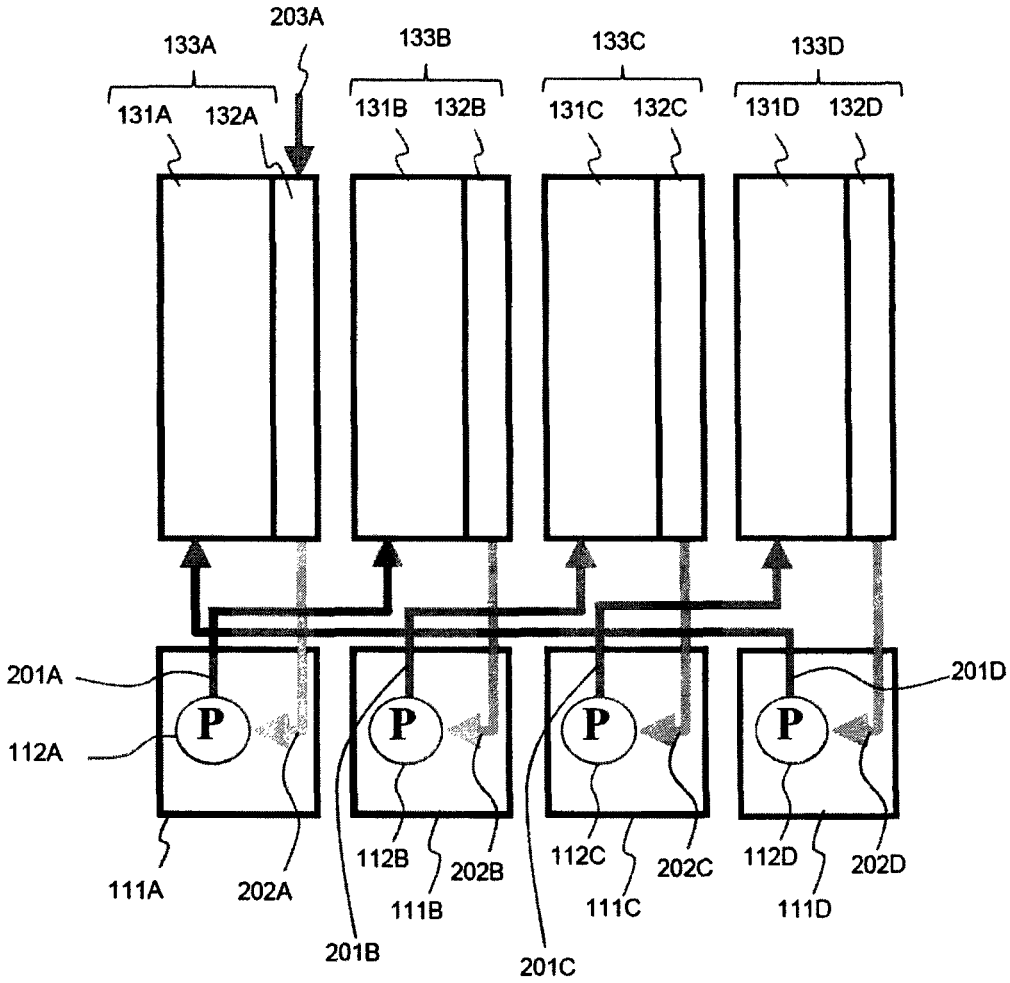
FIG. 8 is a schematic view of plating tanks according to a comparative example with respect to the plating tanks of the plating apparatus according to the first embodiment of the present invention.

FIG. 7 is a graph showing how the mixture ratios of a plating solution in the plating tanks of the plating apparatus according to the first embodiment of the present invention shown in FIG. 4 change with time. FIG. 8 is a schematic view of plating tanks of a plating apparatus according to a comparative example with respect to the plating apparatus according to the first embodiment of the present invention. FIG. 9 is a graph showing how the mixture ratios of a plating solution in the plating tanks shown in FIG. 8 change with time.

The graph of FIG. 7 represents the results of a simulation, showing how the mixture ratios of a plating solution in the four interconnected plating tanks 133A through 133D according to the first embodiment shown in FIG. 4, with all the plating tanks 133A through 133D being supplied with the additives 203A through 203D, change with time. The graph of FIG. 9 represents the results of a simulation, showing how the mixture ratios of a plating solution in the four interconnected plating tanks 133A through 133D according to the comparative example shown in FIG. 8, with only one 133A of the plating tanks 133A through 133D being supplied with the additive 203A, change with time.

The simulations were made under such conditions that the inner tanks 131A through 131D had a volume twice the outer tanks 132A through 132D, e.g., the inner tanks 131A through 131D had a volume of 20 L and the outer tanks 132A through 132D had a volume 10 L, and the plating solution was circulated into inner tanks 131A through 131D at a rate of 2 L/min. FIG. 7 specifically shows how the amounts of the additive 203A through 203D changed with time in the inner tanks 131A through 131D and the outer tanks 132A through 132D after 2.5 L of the additives 203A through 203D were added to the respective outer tanks 132A through 132D when 20 L of a solvent had been present in the inner tanks 131A through 131D and 7.5 L of a solvent had been present in the outer tanks 132A through 132D. FIG. 9 specifically shows how the amounts of the additive 203A changed with time in the inner tanks 131A through 131D and the outer tanks 132A through 132D after 10 L of the additive 203A was added to the outer tank 132A only when 20 L of a solvent had been present in the inner tanks 131A through 131D and 10 L of a solvent had been present in the outer tanks 132B through 132D except the outer tank 132A.

A study of FIG. 7 indicates that according to the first embodiment of the present invention, when 2.5 L of the additives 203A through 203D are added to the respective outer tanks 132A through 132D, it takes about 15 minutes for the plating solution to be uniformly mixed in the inner tanks 131A through 131D and the outer tanks 132A through 132D.

Figure 9:
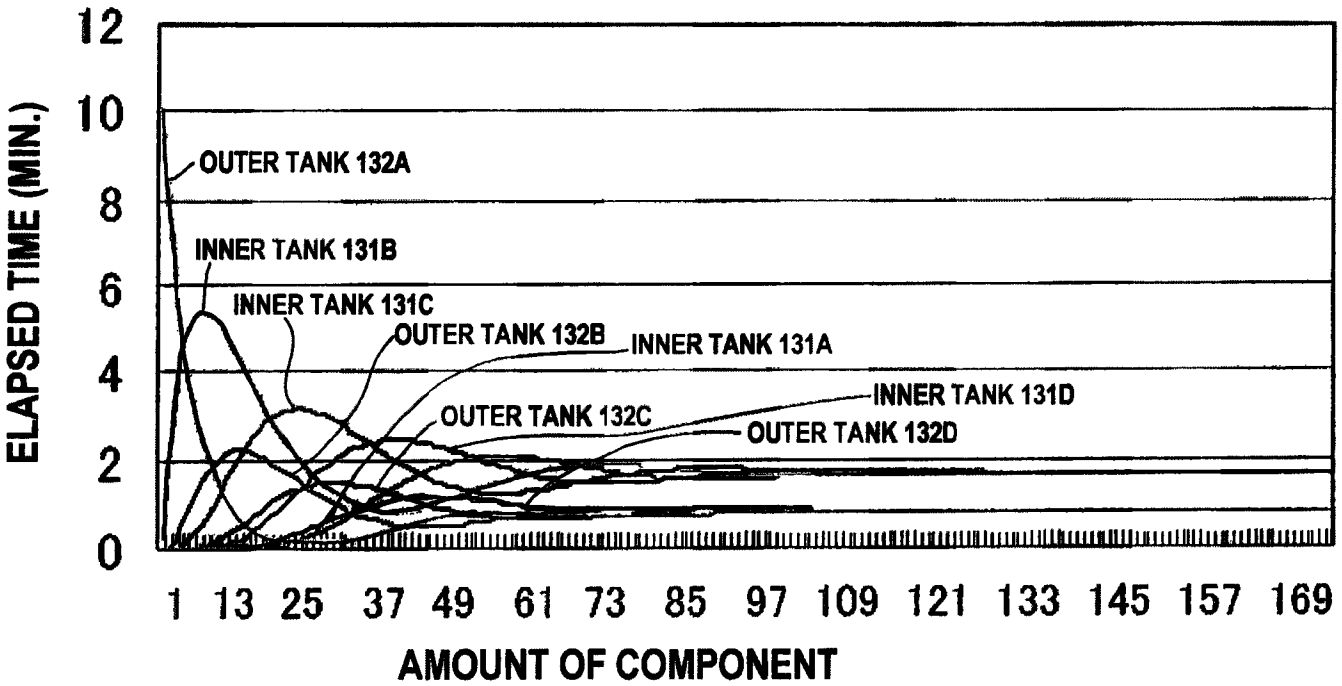
FIG. 9 is a diagram showing how the mixture ratios of a plating solution in the plating tanks shown in FIG. 8 change with time.

A study of FIG. 9 indicates that according to the comparative example, when 10 L of the additive 203A is added to the outer tank 132A only, the plating solution is not uniformly mixed in the inner tanks 131A through 131D and the outer tanks 132A through 132D within about 15 minutes, but it takes about 130 minutes for the plating solution to be uniformly mixed in the inner tanks 131A through 131D and the outer tanks 132A through 132D.

It can be seen from FIGS. 7 through 9 that it is necessary to supply the additives 203A through 203D to the plating tanks 133A through 133D in order for the additives 203A through 203D to be quickly mixed with the plating solution in the interconnected plating tanks 133A through 133D. In other words, the plating solution in the plating tanks 133A through 133D can be mixed together within a short period of time by supplying the plating tanks 133A through 133D with the additives 203A through 203D, respectively.

With the plating apparatus according to the first embodiment of the present invention, therefore, the plating solution can be mixed and circulated in the interconnected plating tanks 133A through 133D within a short period of time by supplying the plating tanks 133A through 133D with the additives 203A through 203D, respectively. This also holds true for the plating apparatus according to the second and third embodiments of the present invention.

Figure 10:
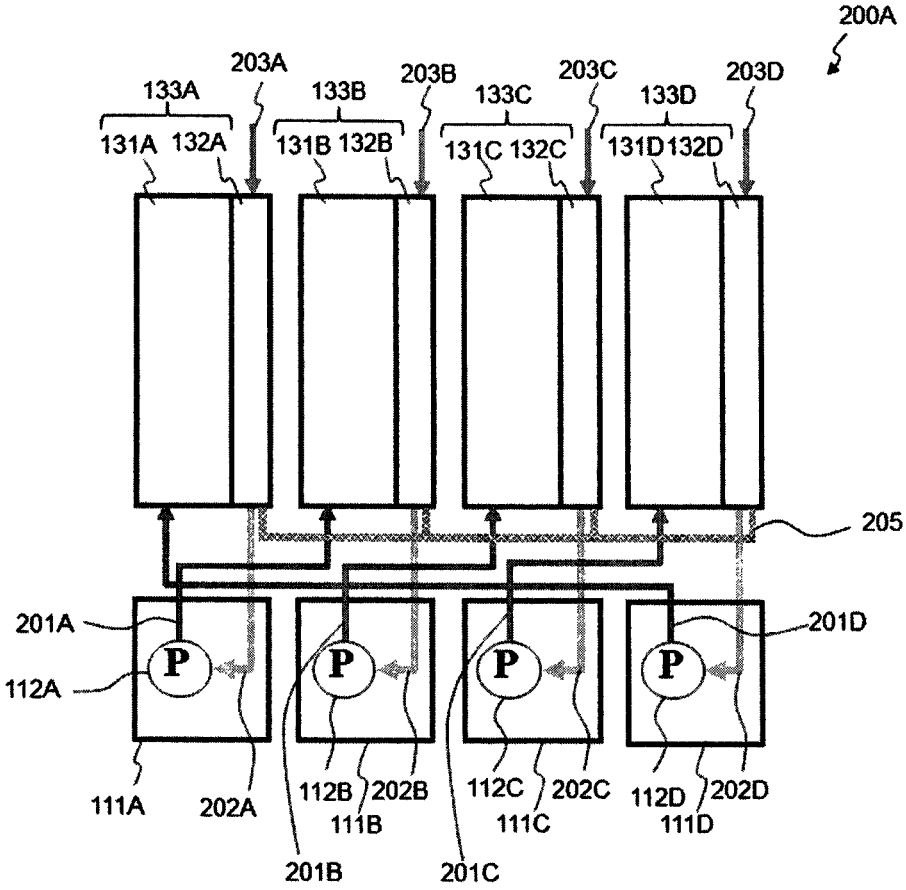
FIG. 10 is a schematic view showing a balancing pipe according to a first example which is added to the plating apparatus according to the first embodiment of the present invention.
Figure 11:
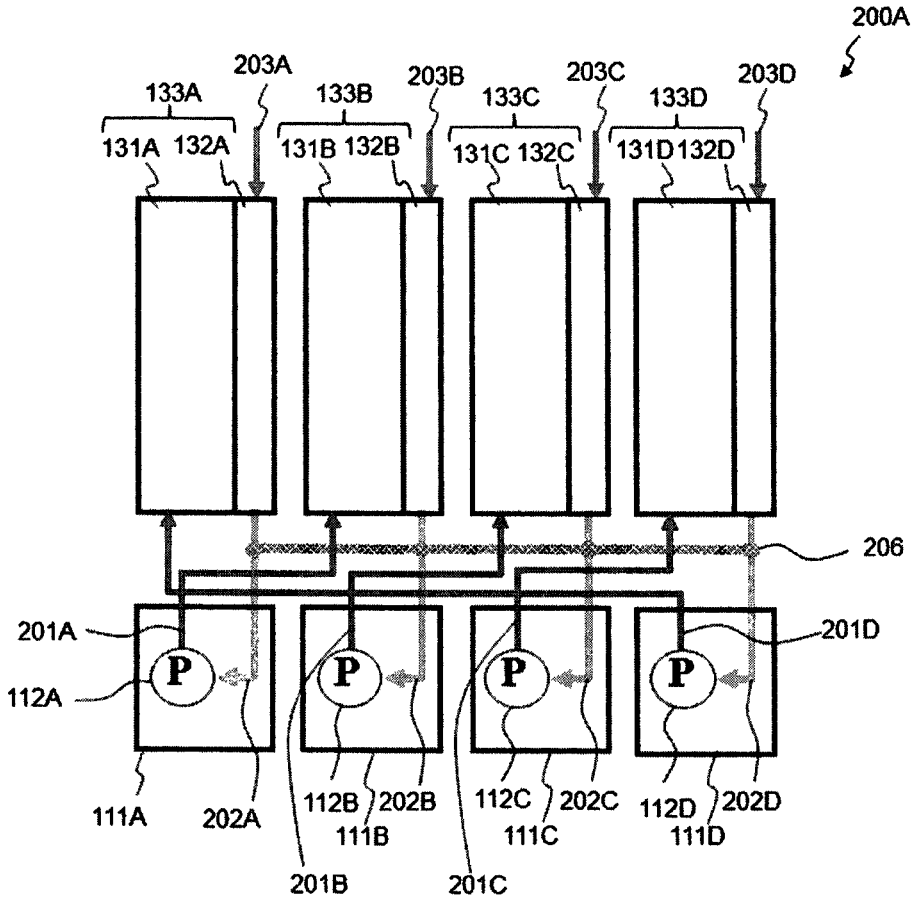
FIG. 11 is a schematic view showing a balancing pipe according to a second example which is added to the plating apparatus according to the first embodiment of the present invention.

As shown in FIGS. 10 and 11, the plating apparatus according to the first embodiment of the present invention may additionally include balancing pipe 205 or 206 interconnecting the plating tanks 133A through 133D. This also holds true for the plating apparatus according to the second and third embodiments of the present invention. FIG. 10 is a schematic view showing the balancing pipe 205 according to a first example which is added to the plating apparatus according to the first embodiment of the present invention. FIG. 11 is a schematic view showing the balancing pipe 206 according to a second example which is added to the plating apparatus according to the first embodiment of the present invention.

The balancing pipes 205, 206 added to the plating apparatus will be described below with reference to FIGS. 10 and 11.

If the pumps 112A through 112D of the plating apparatus, which includes the interconnected plating tanks 133A through 133D, have different discharge rates, then the balance of the amounts of the plating solution in the respective plating tanks 133A through 133D may possibly be disturbed. For example, the levels of the plating solution in the outer tanks 132A through 132D, which receive the plating solution overflowing the inner tanks 131A through 131D, may become different from each other, so that some of the plating tanks 133A through 133D, which are supplied with more plating solution than the other plating tanks, may cause their outer tanks to overflow with the plating solution.

In order to eliminate the imbalance between the different levels of the plating solution in the outer tanks 132A through 132D, the plating apparatus may have a controller for monitoring the levels of the plating solution in the outer tanks 132A through 132D and adjusting the discharge rates of the pumps 112A through 112D in the event that the monitored levels have changed out of a preset range. However, the controller needs to perform a complex control process because the combination of the plating tanks 133A through 133D whose solution levels have to be controlled and the circulating units 111A through 111D whose discharge rates have to be controlled varies depending on the connected pattern of the pipes 201A through 201D, 202A through 202D. If the discharge rates of the pumps 112A through 112D are controlled by an inverter or the like, then since small flow rates need to be adjusted, the inverter is required to be controlled according to a complex control process which tends to be highly costly.

The plating apparatus according to the first embodiment of the present invention includes the balancing pipe 205 or 206 interconnecting the outer tanks 132A through 132D for uniformizing the amounts of the plating solution in the plating tanks 133A through 133D. The balancing pipes 205, 206 shown in FIGS. 10 and 11 are illustrated as being added to the plating apparatus according to the first embodiment shown in FIG. 4. However, the balancing pipe 205 or 206 may be added to the plating apparatus according to the second and third embodiments shown in FIGS. 5 and 6 insofar as the balancing pipe 205 or 206 interconnects the plating tanks that are connected in series with each other, and hence are not limited to the illustrated structures.

As shown in FIG. 10, the balancing pipe 205 interconnects the outer tanks 132A through 132D of the plating tanks 133A through 133D that are connected in series with each other. As shown in FIG. 11, the balancing pipe 206 interconnects the suction pipes 202A through 202D which extend from the outer tanks 132A through 132D of the plating tanks 133A through 133D to the respective pumps 112A through 112D. Even when the discharge rates of the pumps 112A through 112D are different from each other, the balancing pipe 205 or 206 allows the plating solution to flow from those of the outer tanks 132A through 132D which receive more plating solution to those of the outer tanks 132A through 132D which receive less plating solution. Therefore, the balancing pipe 205 or 206 is effective to prevent the balance of the amounts of the plating solution in the respective plating tanks 133A through 133D from being disturbed.

The outer tanks 132A through 132D may have respective joints for connection to the balancing pipe 205 shown in FIG. 10, or the suction pipes 202A through 202D may have respective joints for connection to the balancing pipe 206 shown in FIG. 11. If the balancing pipe 205 or 206 is not connected, then those joints may be closed by closure plugs. Alternatively, the balancing pipe 205 may permanently be connected to the outer tanks 132A through 132D or the balancing pipe 206 may permanently be connected to the suction pipes 202A through 202D, and the balancing pipe 205 or 206 may have valves which may selectively be closed to block desired portions of the balancing pipe 205 or 206. However, if the balancing pipe 205 is permanently connected to the outer tanks 132A through 132D or the balancing pipe 206 is permanently connected to the suction pipes 202A through 202D, then it is difficult to clean the interior of the balancing pipe 205 or 206 when the plating tanks 133A through 133D and the pipes 201A through 201D, 202A through 202D are cleaned. Therefore, it is desirable to provide the joints for connection to the balancing pipes 205, 206, and to connect the balancing pipe 205 or 206 to desired ones of the joints. The joints thus provided make it easy to change the pattern in which the balancing pipe 205 or 206 is connected depending on the pattern of operation of the plating apparatus.

The plating apparatus according to the first embodiment of the present invention, which is combined with the balancing pipe 205 or 206, is capable of adjusting the amounts of plating solution in the plating tanks 133A through 133D with a simple and inexpensive structure. This also holds true for the plating apparatus according to the second and third embodiments of the present invention.

Each of the plating apparatus according to the second and third embodiments of the present invention includes a plurality of plating modules using different types of plating solutions and can perform different plating processes with the respective plating modules. If the number of different types of plating solutions is small, then a plurality of plating tanks, which use a common plating solution, may be connected in series with each other to mix and circulate the plating solution, and the number of titrating processes required can be reduced. The plating apparatus according to the first through third embodiments of the present invention allow the pipes to be reconnected to provide plating modules depending on the number of different types of plating solutions used, and are capable of mixing and circulating the different types of plating solutions in the respective plating modules without developing cavitation with a simple structure.

In the illustrated embodiments of the present invention, the return pipes or suction pipes from the outer tanks 132A through 132D are directly connected to the suction ports of the pumps 112A through 112D. However, buffer tanks may be connected between the outer tanks 132A through 132D and the suction ports of the pumps 112A through 112D. The outer tanks 132A through 132D, which are illustrated in the embodiments of the present invention, may be dispensed with insofar as the return pipes or suction pipes from the plating tanks 133A through 133D are connected to the suction ports of the pumps 112A through 112D and the discharge pipes from the pumps 112A through 112D are connected to different ones of the plating tanks 133A through 133D, thereby connecting the plating tanks 133A through 133D in series with each other.

Although certain preferred embodiments of the present invention have been shown and described in detail, it should be understood that various changes and modifications may be made therein without departing from the scope of the appended claims.

What is claimed is:

1. A plating apparatus for plating a surface to be plated of a substrate, comprising:

a plurality of plating tanks for holding a plating solution therein;

a plurality of pumps combined respectively with the plating tanks, for circulating the plating solution through the plating tanks;

a plurality of suction pipes connecting respective suction ports of the pumps to the plating tanks, respectively; and a plurality of discharge pipes connecting respective discharge ports of the pumps to respective different ones of the plating tanks from the plating tanks which are connected to the suction ports of the pumps;

wherein the plating tanks and the pumps are connected in series with each other.

2. A plating apparatus according to claim 1, wherein the plating tanks include respective inner tanks each for plating the substrate by immersing it in the plating solution, and respective outer tanks for receiving the plating solution which overflows the inner tanks.

3. A plating apparatus according to claim 2, wherein the discharge pipes are connected to the inner tanks, respectively, and the suction pipes are connected to the outer tanks, respectively.

4. A plating apparatus according to claim 1, further comprising:

a substrate holder for holding the substrate;

an anode immersed in each of the plating tanks; and a plating power source for applying a voltage between the surface of the substrate and the anode.

5. A plating apparatus according to claim 4, further comprising:

a paddle for agitating the plating solution, the paddle being disposed between the anode and the substrate in each of the plating tanks.

6. A plating apparatus according to claim 5, further comprising:

a regulation plate disposed in each of the plating tanks between the anode and the substrate to divide the plating solution into a region near the anode and a region near the substrate, the regulation plate having a central hole defined therein that is essentially identical to an external shape of the substrate.

7. A plating apparatus according to claim 1, wherein the discharge pipes are reconnectable to provide a different interconnected combination of the discharge ports of the pumps and the plating tanks.

8. A plating apparatus according to claim 1, wherein additives are added to the plating solution in the plating tanks, respectively.

9. A plating apparatus according to claim 1, wherein the plating tanks and the pumps are connected in series with each other in a plurality of plating modules which use respective different types of plating solutions therein.

10. A plating apparatus according to claim 1, further comprising:

a balancing pipe interconnecting the plating tanks.

* * * * *